US006531657B1

(12) United States Patent
Jones, Jr. et al.

(10) Patent No.: US 6,531,657 B1
(45) Date of Patent: Mar. 11, 2003

(54) ADAPTER WIRE HARNESS FOR INSTALLING DIFFERENT AUTOSOUND COMPONENTS INTO DIFFERENT VEHICLES

(75) Inventors: William H. Jones, Jr., Ormond Beach, FL (US); David D. Schaefer, DeLeon Springs, FL (US); John J. LeLasher, III, South Daytona, FL (US); William E. Lauer, Ormond Beach, FL (US)

(73) Assignee: Metra Electronics Corporation, Holly Hill, FL (US)

( * ) Notice: Subject to any disclaimer, the term of this patent is extended or adjusted under 35 U.S.C. 154(b) by 0 days.

(21) Appl. No.: 10/059,120

(22) Filed: Jan. 31, 2002

(51) Int. Cl.[7] ..... H01B 7/04

(52) U.S. Cl. ..... 174/72 A; 174/112; 439/502; 439/488

(58) Field of Search ..... 439/502, 488, 439/35; 174/112, 72 A

(56) References Cited

U.S. PATENT DOCUMENTS

| | | | | |
|---|---|---|---|---|
| 4,820,172 A | | 4/1989 | Wolkewitz et al. | 439/76 |
| 4,820,189 A | | 4/1989 | Sergeant et al. | 439/395 |
| 5,292,261 A | | 3/1994 | Hirano et al. | 439/752 |
| 4,660,914 A | | 4/1997 | Nakamura | 339/59 R |
| 5,649,841 A | | 7/1997 | Martinez et al. | 439/712 |
| 5,917,151 A | * | 6/1999 | O'Brien et al. | 174/72 A |
| 5,971,799 A | | 10/1999 | Swade | 439/502 |
| 6,007,372 A | * | 12/1999 | Wood | 439/502 |
| 6,040,760 A | | 3/2000 | Kataoka et al. | 340/425.5 |
| 6,064,177 A | | 5/2000 | Dixon | 320/111 |
| 6,107,696 A | | 8/2000 | Peter et al. | 307/31 |
| 6,280,243 B1 | | 8/2001 | Liu et al. | 439/502 |
| 6,326,704 B1 | | 12/2001 | Breed et al. | 307/9.1 |
| 6,340,321 B2 | | 1/2002 | Sawayanagi | 439/877 |
| 2001/0010985 A1 | | 8/2001 | Kasai | 439/638 |
| 2001/0025206 A1 | | 9/2001 | Takada et al. | 700/150 |
| 2001/0027896 A1 | | 10/2001 | Reus | 181/199 |

OTHER PUBLICATIONS

Metra 2001 Autosound Installation Products, pp. 63–98, Published Feb. 2001.

Metra 2001 New Products Supplement, Published Jan., 2002.

* cited by examiner

*Primary Examiner*—Anthony Dinkins
*Assistant Examiner*—Jinhee J Lee
(74) *Attorney, Agent, or Firm*—Fitzpatrick, Cella, Harper & Scinto

(57) ABSTRACT

An interchangeable, two piece, adapter wire harness for installing different aftermarket autosound components in different vehicles, characterized by a fixed wiring scheme at an intermediate interconnect. A first piece of the interconnect is coupled by a first set of wires permanently to an autosound component-specific connector and a second piece of the interconnect is coupled by a second set of wires permanently to a vehicle wiring harness-specific connector. The set of possible separate autosound circuit functions is determined by those terminals corresponding to each circuit which are present at corresponding locations in both mated pieces.

12 Claims, 11 Drawing Sheets

| JEEP HARNESS PIN CODE | |
|---|---|
| GREEN | 1 |
| WHITE | 2 |
| BLUE | 3 |
| YELLOW | 4 |
| RED | 5 |
| GRAY | 6 |
| VIOLET | 7 |
| GREEN/BLACK | 8 |
| WHITE/BLACK | 9 |
| ORANGE | 10 |
| ORANGE/WHITE | 11 |
| GRAY/BLACK | 12 |
| VIOLET/BLACK | 13 |
FIG. 3B
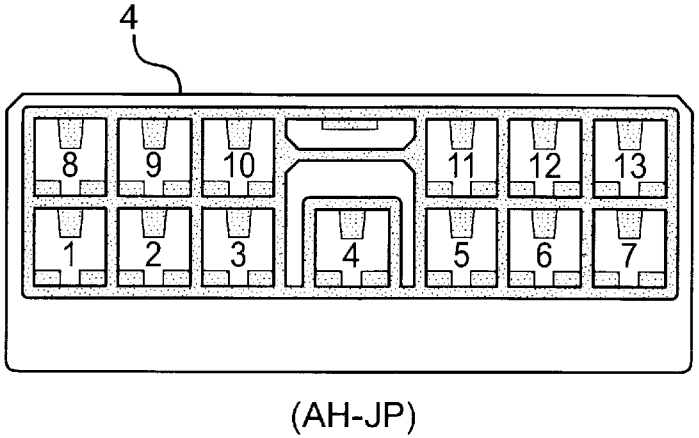
FIG. 3A
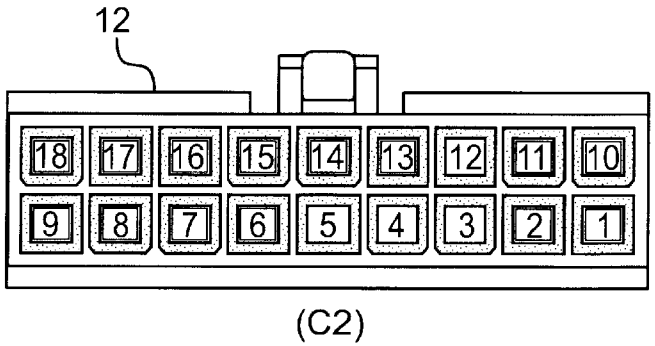
FIG. 4

| INTERCONNECT WIRING COLOR CODE | | C1, C2 PIN CODE |
|---|---|---|
| 12 VOLT IGNITION/Acc. | RED | 18 |
| 12 VOLT BATT/MEMORY | YELLOW | 9 |
| GROUND | BLACK | 17 |
| POWER ANTENNA | BLUE | 8 |
| AMP TURN ON | BLUE / WHITE | 7 |
| AMP GROUND | BLACK / WHITE | 16 |
| ILLUMINATION | ORANGE | 14 |
| DIMMER | ORANGE / WHITE | 15 |
| PHONE MUTE | BROWN | 5 |
| RIGHT FRONT+ | GRAY | 11 |
| RIGHT FRONT- | GRAY / BLACK | 2 |
| LEFT FRONT+ | WHITE | 10 |
| LEFT FRONT- | WHITE / BLACK | 1 |
| RIGHT REAR+ | VIOLET | 13 |
| RIGHT REAR- | VIOLET / BLACK | 4 |
| LEFT REAR+ | GREEN | 12 |
| LEFT REAR- | GREEN / BLACK | 3 |

*FIG. 5*

ADAPTER WIRE HARNESS FOR INSTALLING DIFFERENT AUTOSOUND COMPONENTS INTO DIFFERENT VEHICLES

BACKGROUND OF THE INVENTION

1. Field of the Invention

The present invention relates generally to adapter wire harnesses for installing any non-original equipment manufacturer, or aftermarket, autosound component into different vehicles.

2. Description of the Related Art

Vehicle owners often seek to replace or upgrade the OEM audio system provided by a vehicle manufacturer with an aftermarket autosound component. The terms "autosound component" and "radio" are used herein in their ordinary and broadest sense, and include AM/FM stereo radios, with built-in or head-end controls for tape cassette decks, CD players, DVD players, power amplifiers, cellular phones, security alarms, global positioning systems and any other electronic driver information, convenience or entertainment circuits found on automobiles and like vehicles. The term "autosound component" also conventionally includes loudspeaker systems, power amplifiers auxiliary to the preamplifier or amplifier within a radio and any type of 12 volt electronic components used as part of an electronic driver information, convenience or entertainment system within a vehicle. The term "aftermarket" includes any component that is non-original with respect to the OEM audio system, or which requires an adapter wire harness to be mated with an OEM wiring harness. An aftermarket installation invariably includes the problem that the OEM wiring harness connector found on the vehicle will not mate directly with the terminals on the new autosound component.

Adapter wire harnesses for installing aftermarket autosound components such as upgraded radios typically consist of two separate pieces. A radio-end connector is specific to mating with terminals on the back of the aftermarket autosound component, and has extending color-coded conductor wires. A vehicle harness-end connector is specific to mating with terminals on the OEM vehicle harness and has extending color-coded conductor wires. The installer chooses a radio-specific piece and a vehicle harness-specific piece and then solders or mechanically connects the free ends of each wire coming out from each connector. Hopefully, the wire color codes are compatible exactly between each piece, so that simply making all single, like-color wire end connections will create each required circuit connection. However, correct circuits cannot be assumed in every radio/vehicle application simply by matching wire colors, and the installer must check a schematic circuit diagram or other reference for the specific OEM wiring harness to be sure of making the proper connections.

One attempt to avoid the uncertainty involved in using such prior art two-piece harness pairs has been a series of one-piece adapter wire harnesses, specific to each radio/vehicle combination likely to be desired by a consumer. Examples of prior art two piece and one-piece adapter wire harnesses are those available from Metra Electronics Corporation, of Holly Hill, Florida, the assignee of the present application, under the respective trade designations, TurboWire™ and Smart Cable®.

SWADE (U.S. Pat. No. 5,971,799) describes a Y-shaped harness for interconnecting an OEM vehicle radio and an add-on, aftermarket autosound component. Each of the three connectors is specific to a particular set of autosound component terminals or a specific vehicle harness, and the inventory required to accommodate permutations or combinations of those three variables would be even more burdensome than the inventory required to accommodate two variables. Hence, while such an approach would eliminate the need to hardwire a new component, the harness itself is merely a variant upon the common one-piece wiring harness with two specific connectors, as described above.

PETER et al. (U.S. Pat. No. 6,107,696) describes a circuitry for voltage supplies to various automotive components, wherein a central control unit has various ports into which function modules can be inserted. Such a system merely illustrates the prior art approach of a common bus, with common interconnect housings, so that individual functions can communicate with a controlling device. By contrast, the present invention permits selective matching of a new autosound component with an existing vehicle harness, without requiring any external switching or like control circuitry.

KATAOKA et al. (U.S. Pat. No. 6,040,760) describes a system for selectively installing and addressing various automotive autosound components, wherein multiple operating switches are used to recognize and control the particular component inserted into the system. Such a system likewise merely illustrates the prior art approach of a common bus, with slots in a console having a common interface to accept insertion of one or more individual autosound components. The desired autosound functions then are selected with a controlling device.

Accordingly, there is a need in the art for a simplified inventory of adapter wire harness combinations stocked by distributors and end user installers of aftermarket autosound components. There are at least eleven popular radio-end terminal configurations currently in use, involving aftermarket autosound components manufactured under the trademarks Panasonic®, Alpine®, Sony®, Pioneer®, Aiwa®, Audiovox®, Blaupunkt®, Clarion®, Jensen®, JVC® and Kenwood®. There are at least thirteen popular OEM wiring harness terminal configurations, with seven particularly popular configurations being those found on vehicles from General-Motors Corporation, Ford Motor Corporation, Jeep® (DaimlerChrysler), Honda Mazda, Toyota, and Nissan. An installer would need an inventory of forty, one-piece wiring harness, in order to fit even any one of four popular radio types to any one of ten OEM vehicle wiring harness types. However, an installer would need an inventory of only fourteen wiring harness pieces according to the present invention, in order to fit any one of four radio types to any one of ten OEM vehicle wiring harness types. There also is a need in the art for a way to eliminate installation failures due to inadvertent wire color mismatching or poor contacts during the labor-intensive step of soldering or crimping the wire free ends, when using a two piece harness during installation of a new, aftermarket autosound component. Likewise, there is a need in the art for a way to avoid mistakes, when a single wire, or a pair of wires, must be interconnected in a non-standard fashion. For example, the blue wire from a Pioneer radio must be connected in parallel to both the blue and blue/white stripe wires on any vehicle harness, in order for that Pioneer radio to send a signal that will be able to actuate both a power antenna circuit and an amp-turn-on circuit in any vehicle supporting both functions. The present invention allows the wiring scheme of such a radio-end piece to be adjusted permanently at time of manufacture, so that the correct circuit connections will always be made through the intermediate interconnect, without need for an installer to do anything but mechanically interconnect two mating housings.

SUMMARY OF THE INVENTION

The present invention addresses the foregoing needs in the art by providing a new type of two piece harness system that significantly reduces inventory problems, eliminates failures due to incorrect wire matching and saves installation time. The improvement comprises an interchangeable two piece, releasable, intermediate interconnect system having a fixed wiring scheme. Any first housing of an interconnect is coupled by a first set of wires permanently to an autosound component-specific connector and any second housing of a mating interconnect is coupled by a second set of wires permanently to a vehicle wiring harness-specific connector.

In a first aspect of the present invention, the first piece includes a set of wires sufficient to accommodate all circuit functions supported by each terminal pin on a specific aftermarket autosound component. The second piece accommodates all circuit functions supported by any OEM radio model that originally could have been coupled to the vehicle wiring harness. By virtue of the fixed wiring scheme executed at an interconnect device, any combination of a supported aftermarket autosound component piece and a supported OEM vehicle wiring harness piece will result in a finished adapter wire harness that will execute all mutually compatible circuit functions specific to that combination, simply by making a mechanical interconnection. There is no need for any separate switching or control mechanism, since any wire that represents an unsupported circuit for a particular combination will remain insulated and inactive or discontinuous, within one of the housings of the interconnect. Hence, if a single radio output needs to connect with two circuit inputs on a vehicle harness, as described above for a Pioneer radio, the present invention allows the universal wiring scheme to be implemented permanently by a jumper, at the intermediate interconnect housing associated with the radio. Likewise, the ground for a Jeep vehicle harness is made through the chassis, so the black wire extending from the intermediate interconnect housing associated with the vehicle has a free end with a crimped flat connector, for connection by a screw to the vehicle chassis.

The intermediate interconnect device itself comprises a mating pair of molded nylon or like plastic nonconductive housings, into which a plurality of electrically conductive terminals are mounted. A terminal is mechanically and electrically joined to a conductive lead on a first end of each color-coded wire of first and second sets. Terminals connected to the first ends of the first set of wires are then inserted into a fixed pin location of a first interconnect housing. Terminals connected to the first ends of the second set of wires are then inserted into a fixed pin location of a second interconnect housing. The second ends of the first set of wires are connected to a set of terminals which are inserted into connectors that will mate with a specific autosound component. The second ends of the second set of wires are connected to a set of terminals which are inserted into connectors that will mate with a specific OEM wiring harness. The interconnect terminals are consistently arranged in a predetermined array or scheme in each interconnect housing, in order to be available to close each possible autosound circuit from a predetermined set of circuits. In the preferred embodiment, an 18 terminal interconnect housing is employed, and approximately 14 or 15 terminals, each connected to one wire lead, typically will be mounted in each housing piece used to form a pair. The respective housings and terminals in a pair are mateable with one another in only one orientation, so that the wiring scheme across the intermediate interconnect will be identical for any desired combination of a radio-specific piece and an vehicle harness-specific piece.

The mateable terminals in a pair of electrical interconnector housings are specifically designed to achieve substantial contact forces against one another in their fully mated condition. The proper insertion position is preferably indicated by a latch and ramp contact between the housings. In all preferred embodiments, the interconnector schematically illustrated is a dual row, 18 circuit, flat style 12 volt interconnect for wire of gauge 16AWG to-24AWG, with polarized housings made of nylon or other insulating materials. Such interconnectors are available as the Molex Mini-Fit® 5557 series, from Molex Incorporated, of Lisle, IL or as the AMP-DUAC ™ Series PA 66, from AMP division of TYCO International LTD, of Harrisburg, Pa. These interconnectors are known to provide good electrical performance and very low risk of separation of mated housings, in the high vibration environment of a vehicle underdash. Any other multiple circuit, secure form of releasable interconnect would be equally useful according to the principles of the present invention.

A better understanding of these and other objects, features, and advantages of the present invention may be had by reference to the drawings and to the accompanying description, in which there are illustrated and described different embodiments of the invention. All of the embodiments are considered exemplary of parts of a preferred system embodiment, because any one of the illustrated radio-end pieces will successfully mate with any one of the illustrated vehicle harness-end pieces.

BRIEF DESCRIPTION OF THE DRAWINGS

FIG. 3A is a section view, along line 3—3, of the vehicle harness connector housing shown in FIG. 2. FIG. 3B is a chart illustrating the wire color and pin codes for the particular vehicle harness connector housing shown in FIG. 3A.

FIG. 4 is a section view, along line 4—4, of the intermediate interconnect housing shown in FIG. 2, illustrating the pin code scheme for a first housing of the interconnect.

FIG. 5 is a chart illustrating the preferred fixed wire color to pin code wiring scheme for both interconnect housings, C1 and C2, according to all embodiments of the present invention.

DESCRIPTION OF THE PREFERRED EMBODIMENTS

Figure 1:
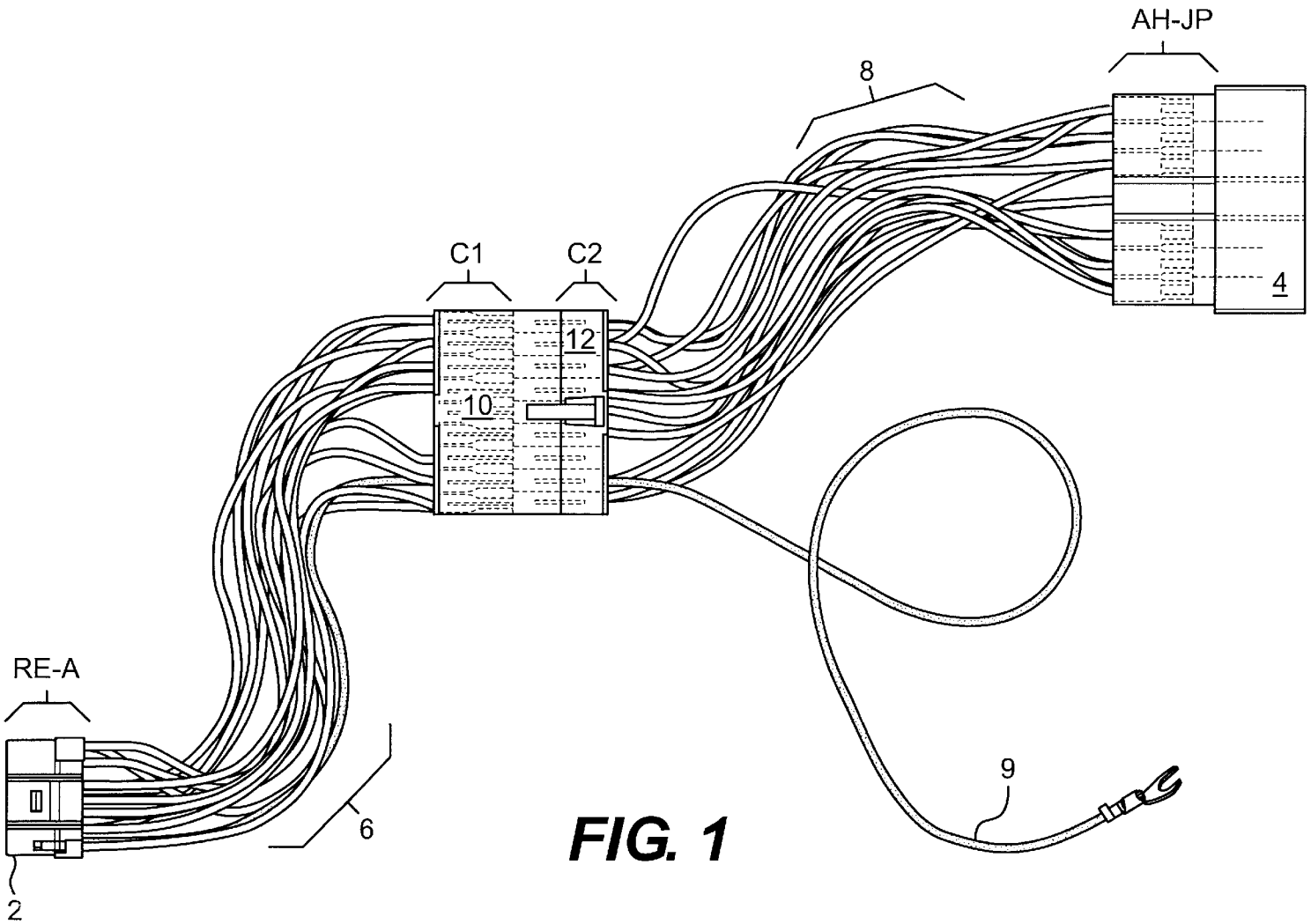
FIG. 1 is a plan view of a preferred embodiment of a two piece adapter wire harness combination, that has been selectively assembled by a user according to the present invention, which is illustrated for a radio-end specific to an aftermarket Alpine radio and a vehicle-end specific to a Jeep wiring harness.

FIG. 1 is a plan view of a preferred embodiment of a two piece adapter wire harness combination, that has been assembled by a user using first embodiments of each piece constructed according to the present invention. The radio-end piece comprises a first set of wires 6 which each extend from a second end terminating at a radio terminal connector RE-A, having a housing 2 that is specific to mate with the terminals on an aftermarket Alpine radio, to a first end terminating at a first interconnect C1, having a housing 10. The vehicle harness-end piece comprises a second set of wires 8 which each extend from a second end terminating at a vehicle harness terminal connector AH-JP, having a housing 4 that is specific to mate with the terminals on a Jeep wiring harness, to a first end terminating at second interconnect C2 having a housing 10. The wires in each set are typical of those used in OEM automotive wiring harnesses, with a copper stranded core in a gauge between 16AWG and 20 AWG, and sheathed in colored vinyl jackets.

Figure 2:
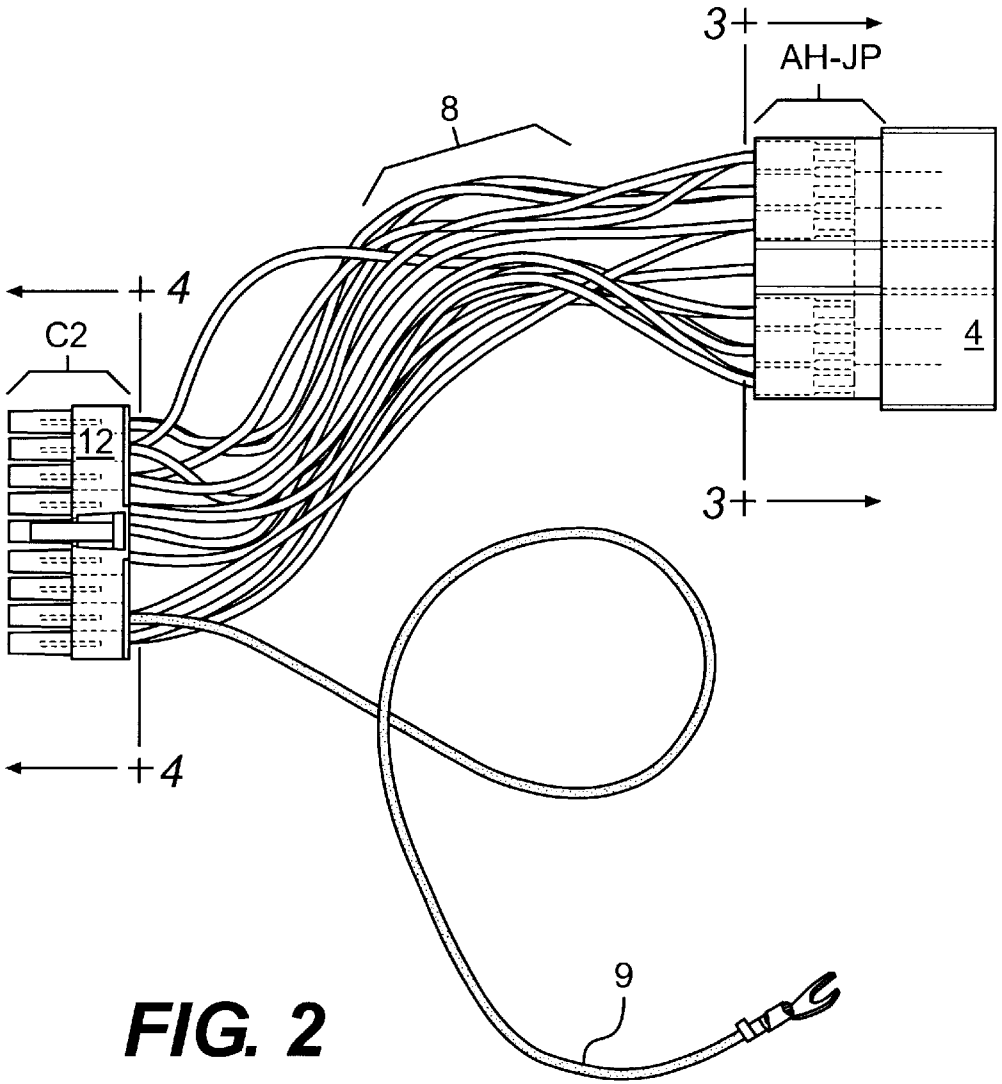
FIG. 2 is a plan view of a first embodiment for a separate vehicle harness-end piece, and according to the embodiment shown in FIG. 1.

FIG. 2 is a plan view of a first embodiment for a separate vehicle harness-end piece, and according to the embodiment shown in FIG. 1. As described above, the ground for a Jeep vehicle harness is made through the chassis, not housing 4, so the black wire 9 extending from the second interconnect C2 has a first end connected to terminal inside housing 12 and a second end which is a distal end terminated with a crimped flat connector, for direct connection to the vehicle chassis. The second wire set 8 consists of fourteen wires, even though the second end of black ground wire 9 is not inserted into a terminal within housing 4 of the vehicle harness terminal connector AH-JP. Hence, the manufacturer of such a piece can always correctly modify any non-standard circuits required by a particular radio or vehicle harness, and that non-standard circuit will be implemented immediately upon interconnect of any two pieces, without need for the installer to be concerned about a missing or incorrect circuit being completed.

FIG. 3A is a section view, along line 3—3, showing a wire insertion view of the pin assignment array of terminals connected to the second ends of second wire set 8, which are inserted into the vehicle harness-end connector housing 4 shown in both FIGS. 1 and 2. Note that the illustration of pin numbers 1–13 for each terminal location within housing 4 at FIG. 3A conforms to an embossed pattern found on connectors for this type of Jeep wiring harness. Those Jeep pin numbers do not equate to the different interconnect pin codes for each terminal location within housings 10 and 12, as summarized at FIG. 5. FIG. 3B is a chart illustrating the how each terminal at the second end of the second set of color-coded wires 8 is to be inserted into openings marked with numbers 1–13, as embossed on the particular Jeep connector housing 4 shown in FIG. 3A.

FIG. 4 is a section view, along line 4—4, schematically showing a wire insertion view of the pin assignment array on the housing 12, and how each terminal at a first end of the color-coded second wire set 8 is to be inserted, in order to create the second interconnect C2, shown in FIG. 2. C2 comprises a nylon or other plastic housing 12 which accepts and holds a set of female terminals in a matching dual row, eighteen circuit, flat style array. As noted above, the preferred interconnect set, C1 and C2, shown connected schematically in FIG. 1, uses a pair of eighteen circuit housings 10, 12 which are available as the Molex 5557 series or the AMP-DUAC Series PA 66. Other styles of housings having multiple circuits also may be employed according to the invention.

Figure 7:
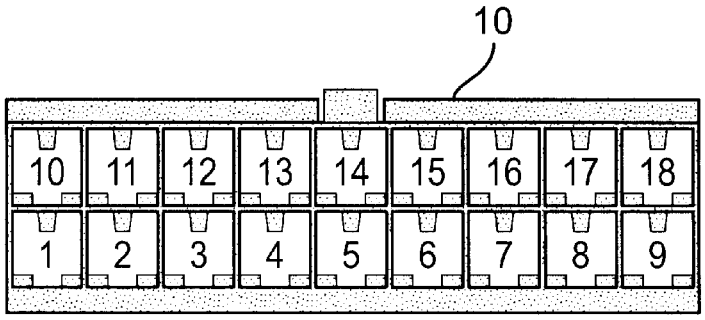
FIG. 7 is a section view, along line 7—7, of the intermediate interconnect housing shown in FIG. 6, illustrating the pin code scheme for a second housing of the interconnect.

FIG. 5 is a chart illustrating the fixed wire color and pin code wiring scheme for both of the interconnect housings according to the illustrations at FIGS. 4 and 7. All illustrated embodiments of the present invention use the same fixed wiring color codes and pin codes to make circuit connections across the interconnect between any C1 and any C2. A preferred fixed set of seventeen wire color codes for auto-sound circuit functions has been illustrated in FIG. 7. Pin code 6 has not been assigned a function, at the present time. Further, the functions identified in the wiring scheme for pin codes 5, 7 and 16 are infrequently present in either a car terminal set or a vehicle wiring harness. Hence, a standard second set of wires 8 for a vehicle-end piece is fourteen, and a standard first set of wires 6 for a radio-end piece is fourteen. As noted above, a significant advantage of the present invention is the ability to permanently affix jumpers or extend free end wires at either connector C1 or C2, in order to create a circuit function that is not separately provided for at either a specific component-end or a specific vehicle harness-end. Since one piece may have fifteen wires, and a mated piece may have only twelve wires, any circuit function not transmitted across a given combination of interconnects C1, C2 is terminated automatically within one of the respective housings 10, 12 whenever a mating terminal, and associated wire, is not present at a given pin location to engage a corresponding terminal that is present at that given pin location.

Figure 6:
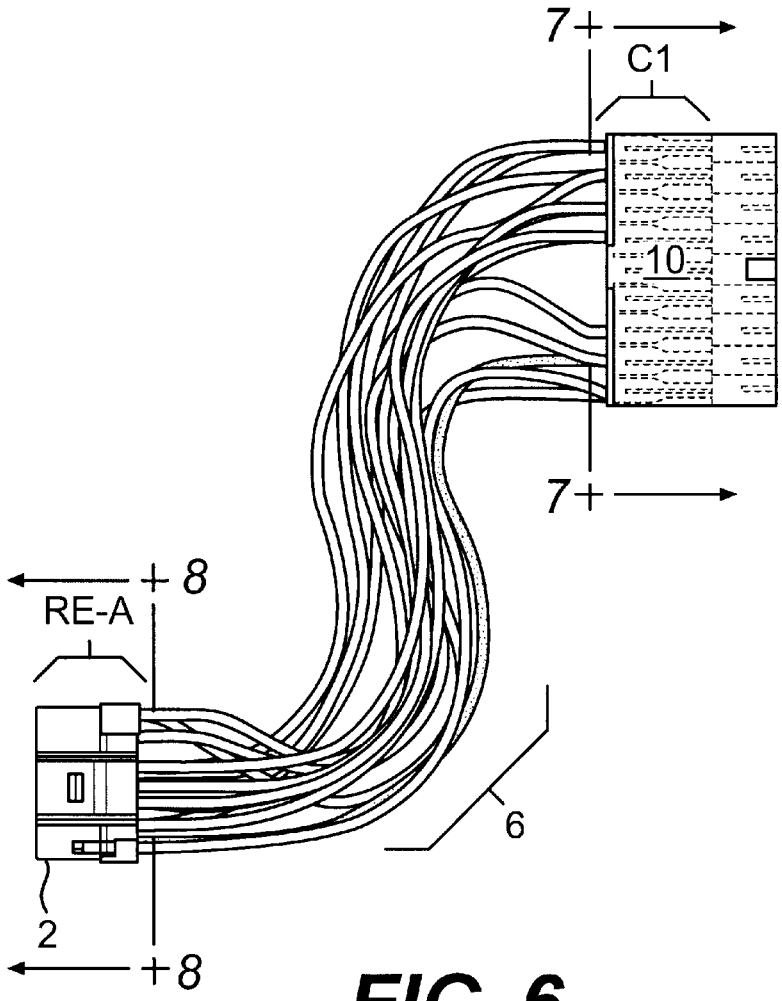
FIG. 6 is a plan view of a first embodiment for a separate radio-end piece, and according to the embodiment shown in FIG. 1.

FIG. 6 is a plan view of a first embodiment for a separate radio-end harness piece, and also according to the embodiment shown in FIG. 1. The Alpine radio-end piece has a first wire set 6 consisting of thirteen color coded wires 6 with first end terminals fixed in a first housing 10 of intermediate interconnect C1, and with second end terminals fixed in housing 2 of radio terminal connector RE-A, that is specific to mate with the terminals on an aftermarket Alpine radio. Those thirteen male terminals are in a dual row, eighteen circuit array within C1, and are available to mate with up to thirteen female terminals which happen to be in corresponding locations in the dual row, eighteen circuit array within any second interconnect C2. The housings 10 and 12 are polarized by detents and shaping molded in the nylon or plastic walls, so that C1 and C2 can be engaged in only one orientation, in a conventional manner.

FIG. 7 is a section view, along line 7—7, schematically illustrating the embossed pin codes which will match up with the pin codes embossed on the first interconnect housing 10 of intermediate interconnect C1. FIG. 7 also shows how each terminal at a first end of the first set of color-coded wires 6 is to be inserted into housing 10 in order to create the intermediate interconnect C1, shown in FIG. 6.

Figure 8:
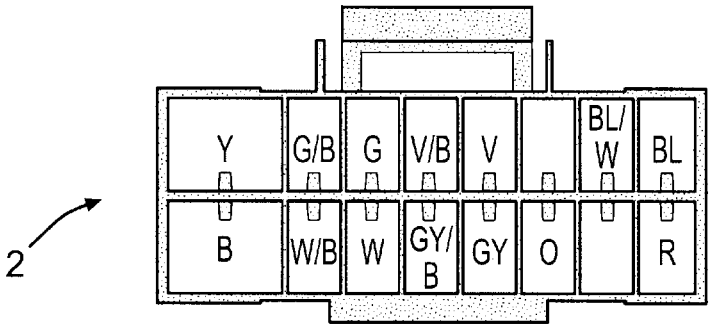
FIG. 8 is a section view, along line 8—8, of the radio-end connector housing shown in FIG. 6, illustrating the wire color and pin locations for the particular radio-end connector housing shown in FIG. 6.

FIG. 8 is a section view, along line 8—8, of the Alpine radio-end connector housing shown in FIG. 6, schematically illustrating the wire color and pin locations for the particular radio-end connector housing shown in both FIGS. 1 and 6. FIG. 8 also shows how each terminal at second ends of the second set of color-coded wires 6 is to be inserted into housing 2, in order to create a connector that correctly mates with terminals on an Alpine radio.

Figure 9:
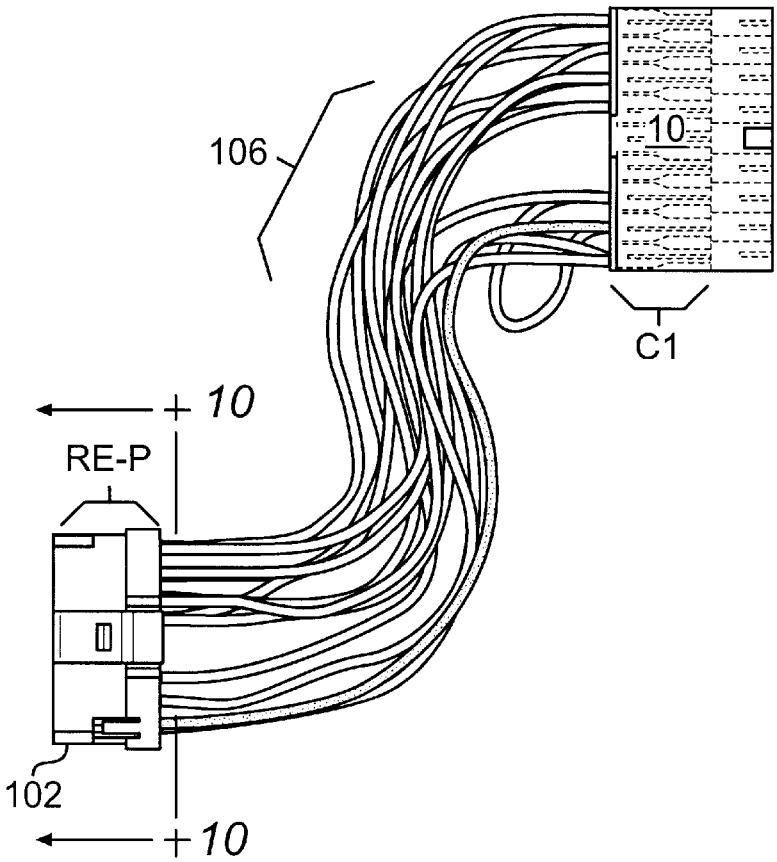
FIG. 9 is a plan view of a second embodiment for a separate radio-end piece according to the invention, which is specific to an aftermarket Pioneer radio.

FIG. 9 is a plan view of a second embodiment for a separate radio-end harness piece, with a radio-end connector RE-P that is specific to an aftermarket Pioneer radio. The C1 connector has a housing 10 that is identical to the housing 10 of FIG. 6, so the same housing reference numeral 10 is used. The first ends of twelve color-coded wires in a first set 106 are inserted into housing 10 according to the same fixed wiring scheme disclosed illustrated in FIGS. 5 and 7. The second ends of the twelve wires in the first set 106 are inserted into the housing 102. However, note that thirteen male terminals are in a dual row, eighteen circuit array within C1, because a jumper is added between Blue/White and Blue, and these now are available to mate with up to thirteen female terminals which happen to be in corresponding locations in the dual row, eighteen circuit array within any mated C2.

Figure 10:
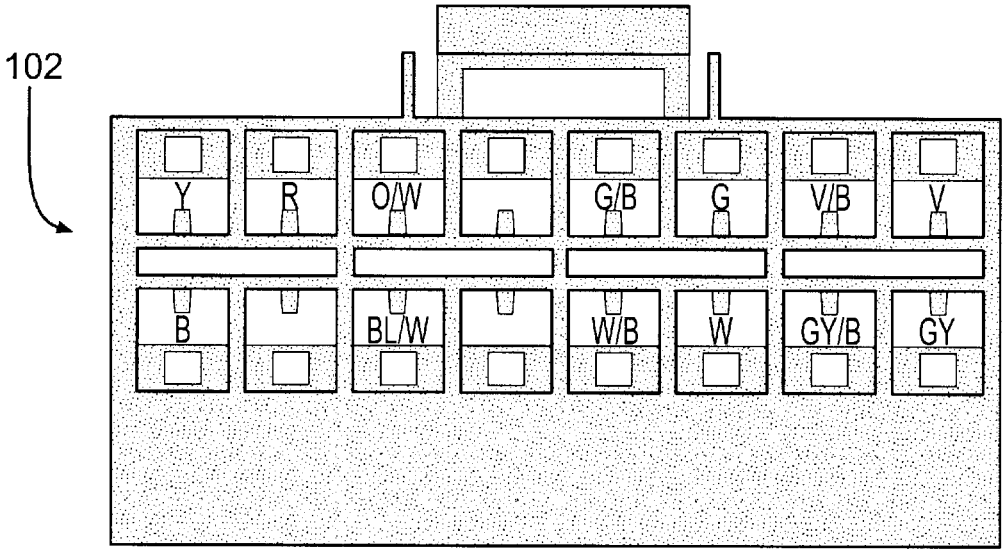
FIG. 10 is a section view, along line 10—10, of the radio-end connector housing shown in FIG. 9, illustrating the wire color and pin locations for the particular radio-end connector housing shown in FIG. 9.

FIG. 10 is a section view, along line 10—10, of the Pioneer radio-end connector housing 102 shown in FIG. 9, schematically illustrating the wire color and pin locations for the particular radio-end connector housing shown in FIG. 9. FIG. 10 is a wire insertion view to show how each terminal at a second end of the first set of color-coded wires 106 is to be inserted into housing 102, in order to create a connector that correctly mates with terminals on a Pioneer radio.

Figure 11:
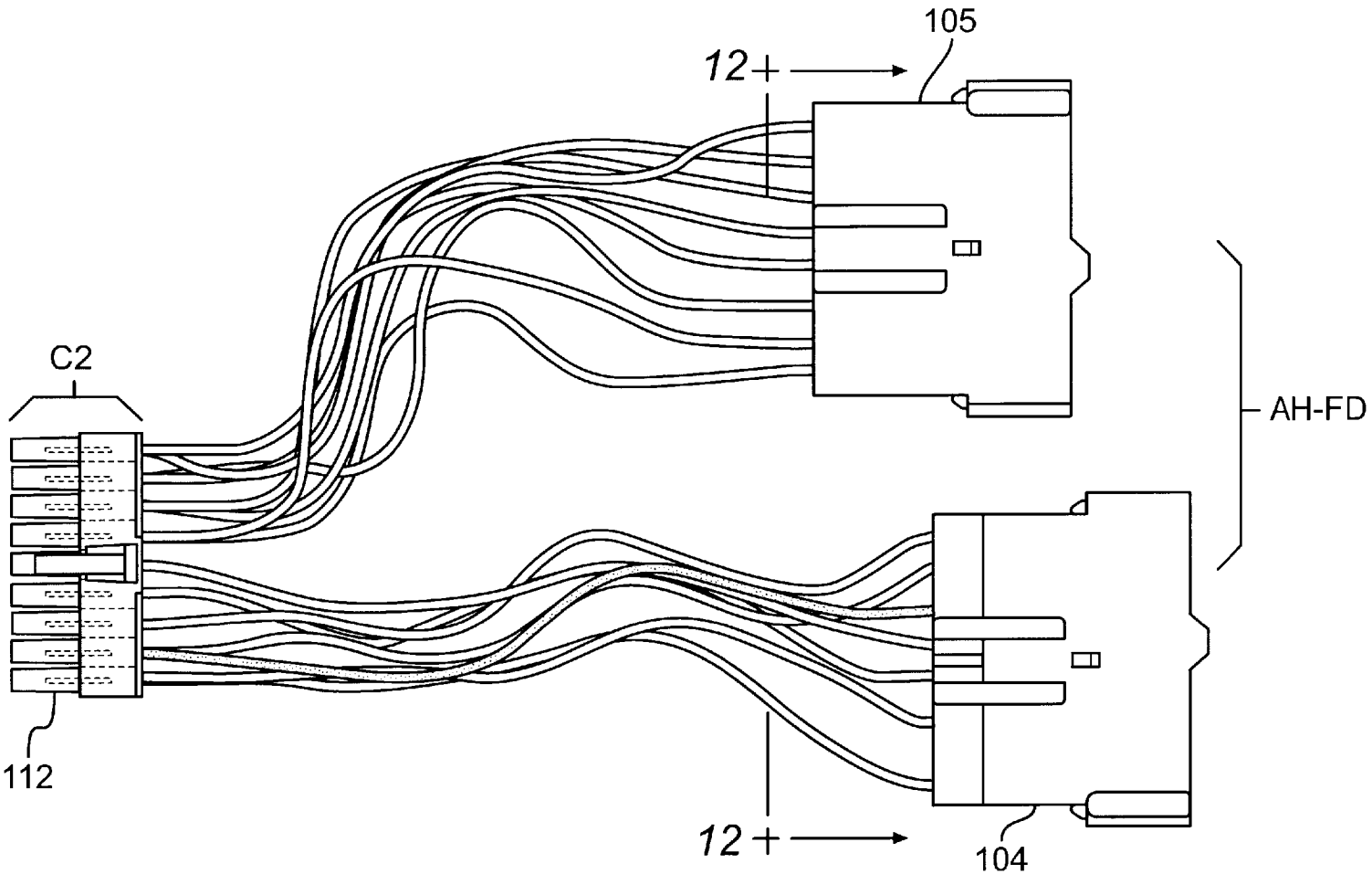
FIG. 11 is a plan view of a second embodiment for a separate vehicle harness-end piece according to the invention, which is specific to a pair of connector housings adapted to a vehicle wiring harness commonly used for the Ford® sound system.

FIG. 11 is a plan view of a second embodiment for a separate vehicle harness-end piece, with a vehicle harness connector AH-FD that is specific to a pair of connector housings found on certain Ford vehicles. The first ends of fifteen color-coded wires in a second set 108 are inserted into housing 12 according to the same fixed wiring scheme illustrated in FIGS. 5 and 7. These fifteen female terminals in C2 now are available to mate with up to fifteen male terminals which happen to be in corresponding locations in the dual row, eighteen circuit array within any C1. FIG. 11 schematically shows how each terminal at second ends of the second set of fifteen color-coded wires 108 is to be inserted into the pair of housings 104, 105 in order to create connectors that correctly mate with terminals on a common vehicle wiring harness used for a Ford sound system.

Figure 12:
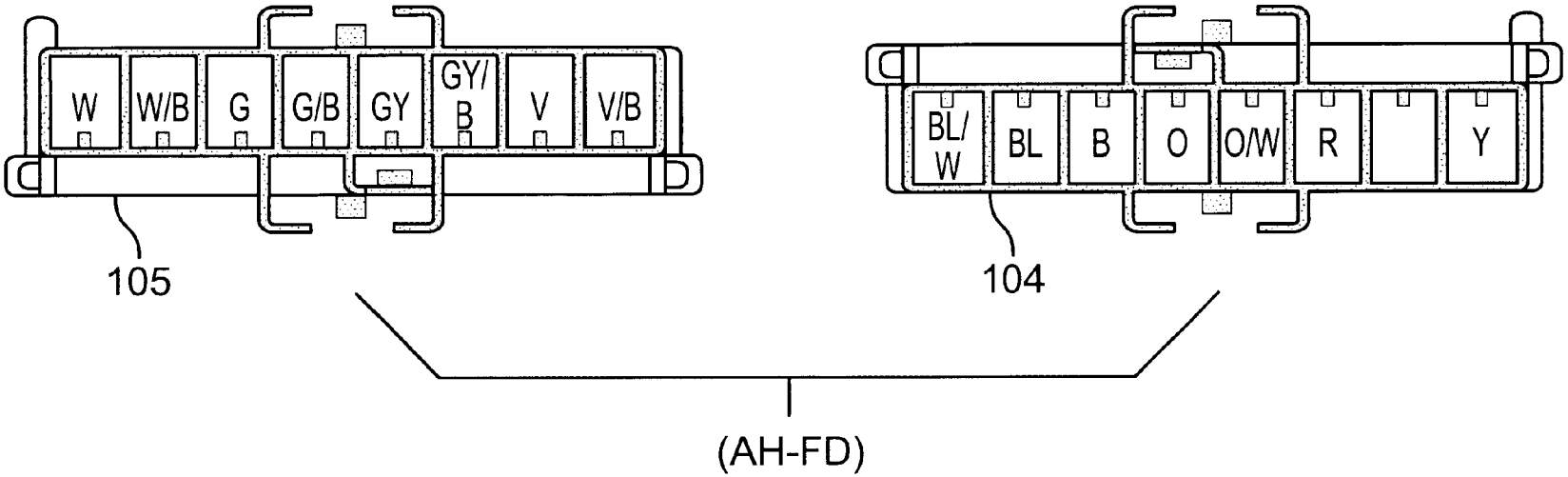
FIG. 12 is a section view, along line 12—12, of the vehicle harness-end connector housing shown in FIG. 11, illustrating the wire color and pin locations for the pair of particular vehicle harness connector housings shown in FIG. 11.

FIG. 12 is a section view, along line 12—12, of the pair of vehicle-end connector housings 104, 105 shown in FIG. 11, schematically illustrating the wire color and pin locations for the pair of Ford sound system vehicle-end connector housings shown in FIG. 11. FIG. 12 is also a wire insertion view of those connectors.

Figure 13:
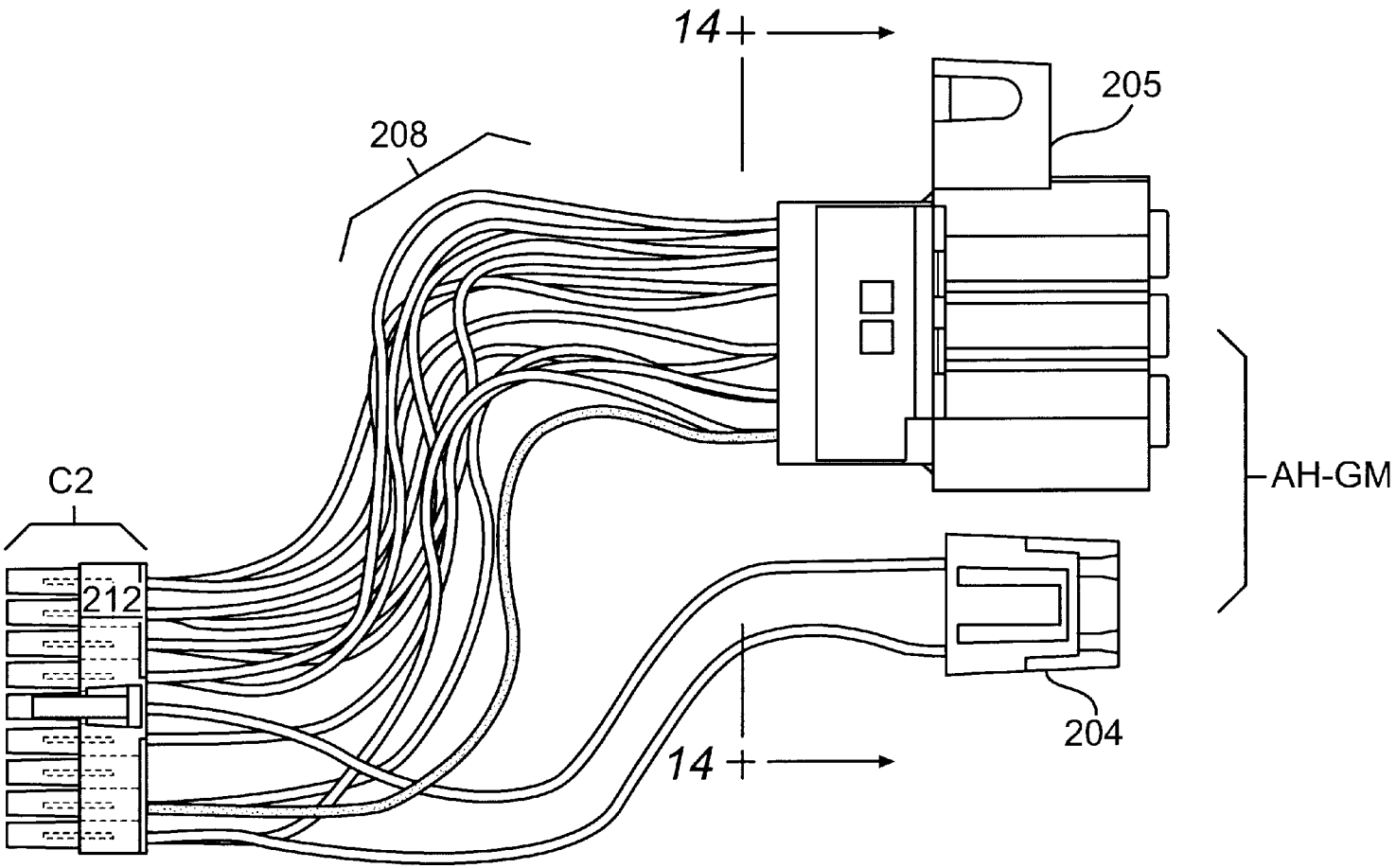
FIG. 13 is a plan view of a third embodiment for a separate vehicle harness-end piece according to the invention, which is specific to a pair of connector housings adapted to a vehicle wiring harness commonly used on GM® vehicles.

FIG. 13 is a is a plan view of a third embodiment for a separate vehicle harness-end piece, with a vehicle harness connector AH-GM, that is specific to a pair of connector housings found on General Motors vehicles. The first ends of fourteen color-coded wires in a second set 208 are inserted into housing 212 according to the same fixed wiring scheme illustrated in FIGS. 5 and 7. These fourteen female terminals in C2 now are available to mate with up to fourteen male terminals which happen to be in corresponding locations in the dual row, eighteen circuit array within any C1. FIG. 13 also shows how each terminal at second ends of the second set of fourteen color-coded wires 208 is to be inserted into the pair of housings 204, 205 in order to create connectors that correctly mate with terminals on a common vehicle wiring harness used for GM vehicles.

Figure 14:
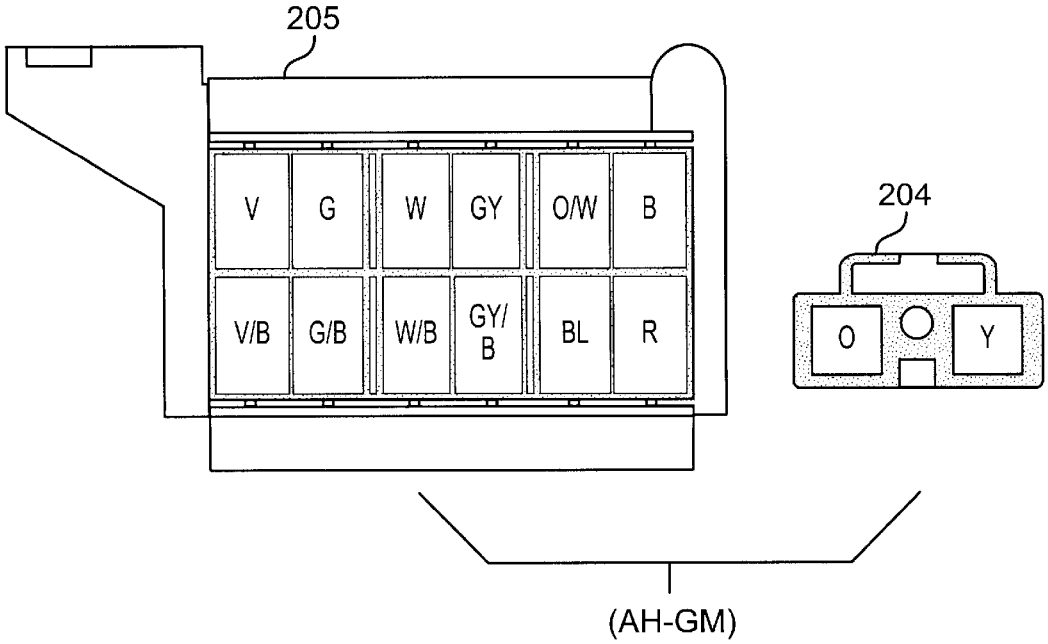
FIG. 14 is a section view, along line 14—14, of the vehicle harness-end connector housing shown in FIG. 13, illustrating the wire color and pin locations for the pair of particular vehicle harness connector housings shown in FIG. 13.

FIG. 14 is a section view, along line 14—14, of the pair of vehicle-end connector housings 204,205 shown in FIG. 13, schematically illustrating the wire color and pin locations for the pair of particular vehicle-end connector housings shown in FIG. 13. FIG. 14 is also a wire insertion view of those connectors.

While preferred embodiments of our invention have been shown and described, the invention is to be solely limited by the scope of the appended claims.

We claim:

1. An adapter wire harness for installing a specific aftermarket autosound component in a specific vehicle comprising two pieces which are interchangeable and selectively mated by a releasable, intermediate interconnect having a fixed wiring scheme, where a first piece comprises a first housing of the interconnect that is permanently coupled by a first set of wires to a component-specific connector and a second piece comprises a second housing of said interconnect that is permanently coupled by a second set of wires to a vehicle harness-specific connector, wherein the first housing of the interconnect and the second housing of the interconnect are always the same for the specific vehicle regardless of the component-specific connector and the vehicle harness-specific connector.

2. An adapter wire harness according to claim 1, wherein the first set of wires comprises a plurality of wires, with each wire extending out of the component-specific connector to accommodate each of a plurality of circuit functions supported by a specific autosound component.

3. An adapter wire harness according to claim 2, wherein the second set of wires comprises a plurality of wires, with each wire extending out of the vehicle harness-specific connector to accommodate each of a pluraliity of circuit functions supported by a specific vehicle wiring harness.

4. An adapter wire harness according to claim 1, wherein the first housing of the interconnect and the second housing of the interconnect are nonconductive, and wherein a plurality of electrically conductive terminals are mounted into the first housing and the second housing, each terminal being mechanically and electrically joined to a conductive lead on a first end of a color-coded wire in each of the first and second sets of wires, wherein the terminals are arranged in each interconnect housing in a fixed array which is available to support a defined set of possible separate autosound circuit functions.

5. An adapter wire harness according to claim 1, wherein the respective interconnect housings further comprise terminals at first ends of the respective first and second sets of wires that are mateable with one another in only one orientation, for any pair of selected pieces, whereby the fixed wiring scheme across the interconnect will be identical for any desired combination of a component-specific piece and a vehicle harness-specific piece, and the interconnection of any component-specific piece and any vehicle harness-specific piece will support all mutually compatible circuit functions for that combination.

6. An adapter wire harness according to claim 1, wherein a mechanical joinder between any pair of mateable interconnect housings closes each circuit in a defined set of possible separate autosound circuit functions, to the extent terminals corresponding to each circuit are present at corresponding locations in both mated housings.

7. An interchangeable adapter wire harness system for installing different aftermarket autosound components in different vehicles, characterized by an intermediate interconnect with a fixed wiring scheme for a defined set of possible separate autosound circuit functions, wherein a first part of the interconnect comprises terminals which are permanently coupled by a first set of wires to an autosound component-specific connector and a second part of the interconnect comprises terminals which are permanently coupled by a second set of wires to a vehicle wiring harness-specific connector, whereby those autosound circuits of the set which is closed is determined by a match between terminals within the interconnect, wherein the terminals of the interconnect are arranged the same way for a specific vehicle regardless of an arrangement of the terminals of the component-specific connector and the vehicle wiring harness-specific connector.

8. An adapter wire harness system according to claim 7, wherein the first set of wires comprises a plurality of wires, with each wire extending out of the component-specific connector to accommodate each of a plurality of circuit functions supported by a specific autosound component.

9. An adapter wire harness system according to claim 7, wherein the second set of wires comprises a plurality of wires, with each wire extending out of the vehicle harness-specific connector to accommodate each of a plurality of circuit functions supported by a specific vehicle wiring harness.

10. An adapter wire harness system according to claim 7, wherein the interconnect further comprises a first and second mateable and nonconductive housings, and the fixed wiring scheme across the interconnect further comprises a plurality of electrically conductive terminals mounted in each housing, each terminal being mechanically and electrically joined to a conductive lead on at least a first end of a color-coded wire in each of the first and second sets of wires, wherein the terminals are arranged in each interconnect housing in a fixed array which is available to support a defined set of possible separate autosound circuit functions.

11. An adapter wire harness system according to claim 7, wherein the intermediate interconnect further comprises a mating between any two of a plurality of mateable pieces, and terminals at first ends of the respective first and second sets of wires in mateable pieces will mate with one another in only one orientation, for any pair of selected pieces, whereby the fixed wiring scheme across the interconnect will be identical for any desired combination of a component-specific piece and a vehicle harness-specific piece, and the interconnection of any component-specific piece and any vehicle harness-specific piece will support all mutually compatible circuit functions for that combination.

12. An adapter wire harness system according to claim 7, wherein a mechanical joinder between any pair of mateable interconnect pieces closes each circuit in a defined set of possible separate autosound circuit functions, to the extent terminals corresponding to each circuit are present at corresponding locations in both mated pieces.

* * * * *